US011346173B2

(12) United States Patent
LaPlante et al.

(10) Patent No.: US 11,346,173 B2
(45) Date of Patent: May 31, 2022

(54) MILLING APPARATUS

(71) Applicant: WELL ENGINEERING TECHNOLOGY FZCO, Dubai (AE)

(72) Inventors: Anthony LaPlante, Dubai (AE); Steven Duthie Nicol, Dubai (AE)

(73) Assignee: WELL ENGINEERING TECHNOLOGY FZCO, Dubai (AE)

( * ) Notice: Subject to any disclaimer, the term of this patent is extended or adjusted under 35 U.S.C. 154(b) by 511 days.

(21) Appl. No.: 15/116,585

(22) PCT Filed: Feb. 6, 2015

(86) PCT No.: PCT/GB2015/050327
§ 371 (c)(1),
(2) Date: Aug. 4, 2016

(87) PCT Pub. No.: WO2015/118339
PCT Pub. Date: Aug. 13, 2015

(65) Prior Publication Data

US 2016/0348456 A1 Dec. 1, 2016

(30) Foreign Application Priority Data

Feb. 7, 2014 (GB) ..... 1402073

(51) Int. Cl.
*E21B 29/06* (2006.01)
*E21B 23/01* (2006.01)
(Continued)

(52) U.S. Cl.
CPC ..... *E21B 29/06* (2013.01); *E21B 7/061* (2013.01); *E21B 23/01* (2013.01); *E21B 23/04* (2013.01); *E21B 33/12* (2013.01); *E21B 34/06* (2013.01)

(58) Field of Classification Search
CPC ..... E21B 29/06; E21B 23/01; E21B 23/04; E21B 33/12; E21B 34/06; E21B 7/061
See application file for complete search history.

(56) References Cited

U.S. PATENT DOCUMENTS 6,050,334 A * 4/2000 McGarian ..... E21B 7/061 166/117.6
6,364,037 B1 * 4/2002 Brunnert ..... E21B 7/061 175/61

(Continued)

FOREIGN PATENT DOCUMENTS

GB 2303158 A 2/1997

OTHER PUBLICATIONS

International Preliminary Report on Patentability for Application No. PCT/GB2015/050327 filed Feb. 6, 2015, and mailed from the International Bureau dated Aug. 18, 2016, 10 pgs.

(Continued)

*Primary Examiner* — Robert E Fuller
*Assistant Examiner* — Neel Girish Patel
(74) *Attorney, Agent, or Firm* — Stoel Rives LLP

(57) ABSTRACT

There is disclosed a milling apparatus (2) having a use in milling a window (88) in downhole tubing (1) located in a borehole (32) of a well. The milling apparatus comprises a main body (22) comprising an internal bore (42) defining a flow path through the body; a mill head (20) having at least one flow port (29); an internal chamber (15) which can contain a fluid, the internal bore of the main body defining at least part of the chamber; first (16) and second (23) seal assemblies disposed within the internal bore; and a communication port (17) located upstream of the second seal assembly. The seal assemblies are initially sealed relative to the main body, so that fluid communication along the internal bore past the seal assemblies is restricted and fluid contained in the chamber isolated from fluid external to the (Continued)

chamber. At least part (11) of the first seal assembly is translatable within the internal bore in a direction towards the second seal assembly, to transmit fluid contained in the chamber through the communication port to a fluid operated device (5) associated with the milling apparatus, to operate the device. At least part (24) of the second seal assembly is translatable within the internal bore from a closed position (FIG. 4) in which said part is in sealing contact with the main body so that said flow port is out of communication with the chamber, to an open position (FIG. 8) in which said part is out of sealing contact with the main body so that fluid can flow along the internal bore past the second seal assembly and so out of the apparatus through said flow port.

32 Claims, 8 Drawing Sheets

(51) Int. Cl.

| | |
|---|---|
| ***E21B 23/04*** | (2006.01) |
| ***E21B 7/06*** | (2006.01) |
| ***E21B 33/12*** | (2006.01) |
| ***E21B 34/06*** | (2006.01) |

(56) References Cited

U.S. PATENT DOCUMENTS

| | | | | |
|---|---|---|---|---|
| 7,077,212 | B2 * | 7/2006 | Roesner | E21B 23/06 166/120 |
| 2003/0098152 | A1 * | 5/2003 | Kennedy | E21B 7/061 166/117.6 |
| 2004/0055755 | A1 * | 3/2004 | Roesner | E21B 23/06 166/382 |
| 2015/0345241 | A1 * | 12/2015 | Glaser | E21B 23/002 166/382 |

OTHER PUBLICATIONS

International Search Report and Written Opinion for PCT/GB2015/050327 filed Feb. 6, 2015, and mailed from the International Searching Authority dated Nov. 13, 2015, 10 pgs.

* cited by examiner

MILLING APPARATUS

RELATED APPLICATIONS

This application is the U.S. National Stage filing under 35 U.S.C. § 371 of International Patent Application No. PCT/GB2015/050327, filed on Feb. 6, 2015 and titled MILLING APPARATUS, which claims the benefit of Great Britain Patent Application No. 1402073.9, filed on Feb. 7, 2014 and titled MILLING APPARATUS, each of which is incorporated herein by reference in its entirety.

The present invention relates to a milling apparatus. In particular, but not exclusively, the present invention relates to a milling apparatus having a use in milling a window in downhole tubing located in a borehole of a well. The present invention also relates to a milling assembly comprising such a milling apparatus, a mill guiding device, and optionally also a fluid operated device for performing a downhole operation.

In the oil and gas exploration and production industry, wellbore fluids comprising oil and/or gas are recovered to surface through a wellbore (or borehole) which is drilled from surface. The wellbore is lined with metal wellbore-lining tubing, which is known in the industry as 'casing'. The casing typically comprises sections of tubing with threaded ends, which are coupled together using casing collars. The casing is sealed in place within the wellbore by pumping 'cement' down the casing, which flows out of the bottom of the casing and along the annulus defined between the external surface of the casing and the internal surface of the drilled wellbore. The casing serves numerous purposes, including: supporting the drilled rock formations; preventing undesired ingress/egress of fluid; and providing a pathway through which further tubing and downhole tools can pass.

It is well known in the industry that production from a particular field can be optimised by drilling one or more 'branch' or 'lateral' wellbores, extending from a main wellbore. In this way, access to multiple zones of a particular field can be achieved through a single, main wellbore extending to a surface facility. This avoids the requirement to drill multiple wellbores from the surface down to the various zones.

Formation of a lateral wellbore requires a number of steps. Firstly, a window must be formed in a wall of the casing which has been installed and cemented in the main wellbore. This requires the positioning of a special mill guiding device known as a 'whipstock' in the main wellbore. The whipstock has a hardened face that is inclined relative to a main axis of the wellbore, forming a ramp which serves for deflecting and so guiding a mill head of a milling apparatus out from the main wellbore, through the casing wall, to form the window. The lateral wellbore can then be extended as required, branching out from the main wellbore. This may involve retrieving the milling apparatus and running in a separate drill string, which is deflected out through the window. The lateral wellbore is then lined with a wellbore-lining tubing known as a 'liner' which extends back and is tied into the casing in the main wellbore. The liner is cemented in the lateral wellbore, and the portion of the liner and cement located in the main wellbore is then milled away, to reopen the main wellbore.

Several different methods for running, orienting and setting a whipstock in a borehole have been proposed. Typically an assembly comprising a drill string having a "measurement-while-drilling" (MWD) tool, a circulating sub/bypass valve, a setting or running tool, a milling apparatus, a whipstock and a hydraulically-set anchor or packer is made-up and run into the main wellbore. The drill string carrying the aforementioned equipment is run into the wellbore until it reaches a required depth. Drilling fluid is then pumped into the drill string and through the bypass valve. The valve is initially open to the annulus defined between the string and the casing wall, and allows the drilling fluid to circulate through appropriate ports, which may for instance be provided in a body of the valve. The MWD tool assesses the orientation of the drill string (and so the whipstock) within the wellbore, using suitable sensors. Circulation of drilling fluid through the drill string allows the MWD tool to transmit data relating to the orientation of the drill string to surface, such as via fluid pressure pulses. This allows an operator of the assembly at surface to determine that the whipstock is oriented in the correct direction for the window which is to be formed in the casing.

Once the orientation of the whipstock has been verified, the drilling fluid flow rate is increased, raising the pressure of the fluid. This results in closure of the annular ports in the bypass valve, so that fluid is directed on through a main bore of the valve to a dedicated running tool deployed above the milling apparatus. This operates the running tool to hydraulically set the anchor/packer, which is situated below the running tool, milling apparatus and whipstock. The running tool contains a 'clean' hydraulic fluid that is used for the purpose of setting the packer/anchor. A piston in the running tool isolates this setting fluid from the drilling fluid, the pressure of drilling fluid applied to the piston operating the running tool to set the packer/anchor. The milling assembly is then released from the whipstock by applying an axial force to the drill string, to break a shear bolt which secures the milling apparatus to the whipstock. Milling can then commence, to form the window, by applying rotation and downward force to the drill string.

Typically, rupture ports or 'knock-off plugs' are employed to achieve circulation of drilling fluid through the mill head, for cooling the head and transporting cuttings to surface, entrained in the drilling fluid. The new, lateral borehole is thus effectively cut out through the side of the tubing into the surrounding formation as the mill travels along the face of the whipstock, through the casing and on into the formation. When milling and drilling of the new, lateral borehole is complete, the whipstock and anchor/packer can be retrieved, via a die collar, hook or other similar method.

As can be seen, typical assemblies currently used to form a lateral wellbore are relatively complex. There is a desire to simplify the assembly, and so the resultant procedure for forming a lateral wellbore. In particular, it would be desirable to provide an assembly which does not require the provision of a running tool containing a fluid for setting the anchor/packer. In addition, the provision of an assembly which requires the discarding of foreign objects such as knock off plugs into the wellbore is undesirable. The plugs can interfere with the window milling process, for example if the discarded portions of the plugs come into contact with the mill head, or if they become lodged between the casing and the assembly in the region of the window. Further, the number of ports in the mill head is restricted, because each port requires a knock-off plug (or similar), and it is desirable to restrict the number of plugs for the reason discussed above. The result of this is that the flow area out of the mill head is relatively restricted, with a consequently poor distribution of drilling fluid from the head.

It is amongst the objects of the present invention to obviate or mitigate at least one of the foregoing disadvantages.

According to a first aspect of the present invention, there is provided a milling apparatus comprising:

a main body;

a mill head; and an internal chamber which can contain a fluid;

in which the milling apparatus can be arranged so that fluid contained in the chamber is isolated from fluid external to the chamber;

and in which the milling apparatus is operable to transmit fluid contained in the chamber to a fluid operated device associated with the milling apparatus, to operate the device.

According to a second aspect of the present invention, there is provided a milling apparatus comprising:

a main body comprising an internal bore defining a flow path through the body;

a mill head having at least one flow port;

an internal chamber which can contain a fluid, the internal bore of the main body defining at least part of the chamber;

a first seal assembly disposed within the internal bore;

a second seal assembly disposed within the internal bore; and a communication port located at a position which is, in use, upstream of the second seal assembly;

in which the first and second seal assemblies are initially sealed relative to the main body, so that fluid communication along the internal bore past the first and second seal assemblies is restricted and fluid contained in the chamber isolated from fluid external to the chamber;

in which at least part of the first seal assembly is translatable within the internal bore in a direction towards the second seal assembly, to transmit fluid contained in the chamber through the communication port to a fluid operated device associated with the milling apparatus, to operate the device;

and in which at least part of the second seal assembly is translatable within the internal bore from a closed position in which said part of the second seal assembly is in sealing contact with the main body so that said flow port is out of communication with the chamber, to an open position in which said part of the second seal assembly is out of sealing contact with the main body so that fluid can flow along the internal bore past the second seal assembly and so out of the apparatus through said flow port.

The present invention addresses problems associated with prior milling apparatus of the type described above. In particular, it may not be necessary to provide a separate setting tool, for operating a fluid operated device such as an anchor/packer associated with the milling apparatus (and which may be employed to anchor/seal an assembly comprising the milling apparatus in a wellbore). Also, the fluid contained within the internal chamber, which is to be transmitted to the device, is isolated from fluid external to the chamber. This helps to avoid contamination of the fluid in the chamber prior to its being supplied to the device. This is important because the fluid external of the chamber will often be a drilling fluid which contains abrasive solids particles that could damage the device, and/or which could result in incorrect operation of the device, if it becomes exposed to the drilling fluid. In addition, other abrasive solids such as drill cuttings may be present in a wellbore into which the milling apparatus is deployed. Isolating the fluid in the chamber from the external fluid prevents contamination of the fluid in the chamber by such abrasive solids, which could otherwise hamper operation of the device.

The milling apparatus may comprise an internal void, which may be an internal bore. The void may be defined by the main body. At least part of the void may be defined by the milling head. The internal bore may extend along a length of the main body to define a flow path therethrough. The internal void may define at least part of the chamber. The milling apparatus may comprise a first seal assembly disposed within the void and sealed relative to the main body and a second seal assembly disposed within the void and sealed relative to the main body, and the internal chamber may be the portion of the void defined between the seal assemblies and a wall of the main body (which wall may form a boundary of the void). Fluid communication along the void past the first and second seal assemblies may be restricted, to thereby isolate the fluid in the chamber. At least part of at least one of the first and second seal assemblies may be translatable relative to the main body within the void.

The first seal assembly may be disposed, at least initially, in the main body. The second seal assembly may be disposed in the mill head. At least part of the first seal assembly may be translatable relative to the main body within the void, in a direction towards the second seal assembly. Such translation may serve to transmit the fluid contained within the chamber from the milling apparatus to the device, to operate the device.

At least one of the first and second seal assemblies may be a piston assembly, comprising a piston which is translatable relative to the main body within the void. The or each piston assembly may be arranged in sealing contact with the main body, and may comprise at least one seal for providing a wiping seal between the piston and the main body during translation of the piston. The first piston assembly may, in use, be an upper or uphole piston assembly. The second piston assembly may, in use, be a lower or downhole piston assembly.

At least part of the first seal assembly may be translatable within the void between: a first or starting position, in which said part of the first seal assembly is spaced along the main body from the second seal assembly; and a second or setting position, in which said part of the first seal assembly is disposed closer to the second seal assembly. Such movement may act to transmit the fluid contained in the chamber to the device. In the first position, said part of the first seal assembly may be out of contact with the second seal assembly. In the second position, said part the first seal assembly may contact the second seal assembly. Said part of the first seal assembly may be retained in the first position by a retaining arrangement. The retaining arrangement may comprise at least one retaining element which prevents translation of said part of the seal assembly until such time as a sufficiently large (typically predetermined) release force is applied to the seal assembly. The retaining element may be a shearable pin, screw, bolt or the like. The retaining element may be rated to shear at a determined, applied pressure imparted on said part of the first seal assembly. The retaining arrangement may comprise a retaining member which is secured to said part of the seal assembly via the retaining element, the retaining member having an outer dimension which is greater than a dimension of the void (or a main part thereof), so as to initially prevent translation of said part of the seal assembly relative to the main body. Application of sufficient force to the seal assembly may shear the retaining element, releasing said part of the seal assembly from the retaining member for translation relative to the main body. The retaining member may be generally annular and may be a retainer ring. The retaining member may be arranged to prevent movement of said part of the first seal assembly in an uphole direction. This may be achieved by sandwiching the retaining member between an end of a connector on a tubular member which serves for deploying the apparatus into a wellbore, and a shoulder or internal wall part of the main body. Said part of the first seal assembly may comprise an abutment surface, such as a shoulder, which cooperates with the retaining member to prevent uphole movement. Where the first seal assembly is a first piston assembly, said part of the seal assembly may be the piston.

At least part of the second seal assembly may be translatable within the void between: a first or closed position, in which said part of the second seal assembly is in sealing contact with the main body; and a second or open position, in which said part of the second seal assembly is out of sealing contact with the main body. Such movement may permit the flow of fluid along the void past the second seal assembly. This may facilitate the opening up of the void for the flow of fluid therethrough, following transmission of the fluid in the chamber to the device. The part of the first seal assembly which is translatable relative to the main body may be arranged to move said part of the second seal assembly from the closed position to the open position. Contact between said part of the first seal assembly (when in its second position) and said part of the second seal assembly may facilitate the application of force to move said part of the second seal assembly to its open position. The first seal assembly may comprise a shear prong, for contacting said part of the second seal assembly to move it to the open position. The shear prong may be releasably coupled to said part of the first seal assembly, for movement therewith. Said part of the second seal assembly may be retained in the first position by a retaining arrangement. The retaining arrangement may comprise at least one retaining element which prevents translation of said part of the seal assembly until such time as a sufficiently large (typically predetermined) release force is applied to the seal assembly. The retaining element may be a shearable pin, screw, bolt or the like. The retaining element may be rated to shear at a determined applied force imparted on said part of the second seal assembly. The retaining arrangement may comprise a retaining member which is secured to said part of the seal assembly via the retaining element, and the retaining member may be secured against movement relative to the main body, so as to initially prevent translation of said part of the seal assembly relative to the main body. The retaining member may be generally annular in shape and positioned within the void, and may be a tubular (circulation) sleeve. Application of sufficient force to the seal assembly may shear the retaining element, releasing said part of the seal assembly from the retaining member for translation relative to the main body. The retaining member may prevent movement of said part of the second seal assembly in an uphole direction. Said part of the second seal assembly may comprise an abutment surface, such as a shoulder, which cooperates with the retaining member to prevent uphole movement. Where the second seal assembly is a second piston assembly, said part of the seal assembly may be the piston.

Said part of the first seal assembly may be movable between: the second position, in which said part of the first seal assembly may be in sealing contact with the main body; and a third or open position, in which said part of the first seal assembly is out of sealing contact with the main body. Such movement may permit the flow of fluid along the void past the first seal assembly. The first seal assembly may be arranged to translate said part of the second seal assembly from its closed position to its open position, when it moves to the third position. This may facilitate the opening up of the void for the flow of fluid therethrough. The void defined by the milling apparatus may comprise an enlarged dimension (which may be a diameter) portion which may receive said part of the first seal assembly when in its third position. A spacing may be defined between an internal wall of the portion of the milling apparatus defining the enlarged dimension portion and an external surface of said part of the first seal assembly.

The milling apparatus may comprise a communication port which communicates with the chamber and with the device, so that the fluid in the chamber can be transmitted to the device. Fluid may exit the chamber via the communication port when said part of the first seal assembly is translated relative to the main body. The communication port may be defined by the main body, and may be located at a position which is (at least initially) upstream or uphole of the second seal assembly and downstream or downhole of the first seal assembly. In this way, during translation of said part of the first seal assembly towards the second seal assembly, and when said part of the second seal assembly is in sealing contact with the main body, fluid in the chamber may be directed out through the communication port.

The milling apparatus may comprise at least one flow port which can be arranged to communicate with the chamber so that fluid can flow through the chamber and out of the apparatus. The at least one flow port may communicate with the chamber when said part of the second seal assembly is in its open position, so that fluid can flow through the chamber and out of the apparatus. When said part of the second seal assembly is in its closed position, the at least one flow port may be out of communication with the chamber. Advantageously, this may avoid a requirement to provide, for example, a knock-off plug to close the flow port, which is generally undesirable. When said part of the first seal assembly is in its third position, and said part of the second seal assembly is in its open position, a flow path may be defined which extends along the void between a wall of the apparatus and an outer surface of said part of the first seal assembly, and between the wall of the apparatus and an outer surface of said part of the second seal assembly. A minimum flow area of said flow path may be greater than a total flow area defined by the at least one flow port. The mill head may define the at least one flow port, which may be downstream or downhole of the first seal assembly.

The mill head may be provided at a leading end of the milling apparatus, and the apparatus may comprise a secondary or follow mill spaced along a length of the apparatus from the mill head. The follow mill may serve for smoothing an edge of a window which is formed in a downhole tubular by the mill head. The follow mill may be provided on the main body. A majority (or main part) of the main body may be of a first outer diameter, the follow mill may extend from the main body to describe a larger second outer (milling) diameter, and portions of the body adjacent the follow mill may be of a reduced third diameter which is less than the first diameter. This may facilitate flexure of the milling apparatus, in the region of the follow mill, when the apparatus is deflected out from a main wellbore e.g. to drill a lateral or branch wellbore. Said portions of the main body may, in use, be uphole and downhole of the follow mill.

The mill head may be coupled to the main body so that rotation of the main body drives and so rotates the mill head.

The mill head may be coupled to the main body via a suitable connection, or may be provided integrally with the main body.

The fluid which is to be provided in the chamber may be a setting fluid, of a type used to operate (or 'set') the device which is associated with the milling apparatus.

According to a third aspect of the present invention, there is provided a milling assembly for milling a window in a downhole tubing, the milling assembly comprising:

- a milling apparatus according to the first aspect of the present invention; and
- a mill guiding device which is releasably coupled to the milling apparatus, for guiding the milling apparatus out through a wall of the downhole tubing to mill a window.

According to a fourth aspect of the present invention, there is provided a downhole assembly comprising:

- a milling apparatus according to the first aspect of the present invention;
- a mill guiding device which is releasably coupled to the milling apparatus, for guiding the milling apparatus out through a wall of the downhole tubing to mill a window; and
- a fluid operated device associated with the milling apparatus, operation of the device being controlled by the milling apparatus.

The mill guiding device may comprise a guide face which is inclined relative to a main axis of the device, the guide face acting, in use, to deflect the milling apparatus out through the wall of the tubing. The mill guiding device may be a whipstock.

The fluid operated device may be an anchor device. When operated, the anchor device may serve for anchoring the mill guiding device within the downhole tubing. The fluid operated device may be a sealing device, and may be an annular sealing device, such as a packer (or a plug), for sealing an annular region defined between a wall of the sealing device and a wall of the tubing. The fluid operated device may be a combination anchor and annular sealing device. It will be understood, however, that the fluid operated device may be one of a wide range of different types of device which are deployed downhole into a wellbore, and which can be operated employing the fluid contained within the chamber in the milling apparatus.

The fluid operated device may comprise an internal chamber which can communicate with the internal chamber defined by the milling apparatus so that, when the milling apparatus is operated to transmit fluid from its chamber to the fluid operated device, the fluid is transmitted to the internal chamber of the device. In this way, the fluid may remain isolated from fluid external to the chambers, restricting the likelihood of contamination. A control or communication line may extend between the chambers. A releasable connection may be provided between the communication line and the milling apparatus, to facilitate release of the milling apparatus from the mill guiding device. The communication line may extend through the mill guiding device. The mill guiding device may define an internal passage which receives or defines at least part of the communication line. The communication line may be coupled to the mill guiding device.

The milling assembly may comprise a releasable connection between the milling apparatus and the mill guiding device. The releasable connection may be arranged to facilitate flexure of the milling apparatus relative to the mill guiding device. The releasable connection may comprise a shearable retaining element, which may be a bolt, screw or pin. The retaining element may be mounted to one of the milling apparatus and the mill guiding device via a deflectable mounting. The deflectable mounting may facilitate deflection of the retaining element about a connection axis extending between the milling apparatus and the mill guiding device. The retaining element may be deflectable to a position in which an axis of the element is disposed transverse to the connection axis. This may facilitate the flexure. The retaining element may be disposed in a mounting bore in the milling apparatus or mill guiding device, and the deflectable mounting may comprise a retaining component which engages the retaining element in such a way that said deflection is permitted. The retaining component may be a retaining dowel which engages in a groove or recess extending at least part way around a perimeter of the portion of the retaining element disposed in the mounting bore, the dowel and groove dimensioned to allow movement of the retaining element within the bore.

It will be understood that the downhole tubing will typically be a wellbore-lining tubing, such as a casing or lining, but that the milling assembly may be used for milling other suitable downhole tubings.

The milling apparatus forming part of the third and/or fourth aspects of the invention may have any one of the further features set out above in or with relation to the milling apparatus of the first or second aspect of the invention.

According to a fifth aspect of the present invention, there is provided a method of milling a window in a downhole tubing, the method comprising the steps of:

- running a milling assembly comprising a milling apparatus, a mill guiding device releasably coupled to the milling apparatus, and a fluid operated device into a wellbore in which a downhole tubing has been located;
- providing a fluid within an internal chamber of the milling apparatus, and arranging the milling apparatus so that the fluid in the chamber is isolated from fluid external to the chamber;
- transmitting the fluid contained within the internal chamber to the fluid operated device;
- operating the fluid operated device using the fluid transmitted from the milling apparatus to the device, to perform a downhole operation; and
- employing the mill guiding device to deflect the milling apparatus out through a wall of the downhole tubing to mill a window.

The fluid operated device may be an anchor, an annular seal element or a combination anchor and annular seal element. The step of operating the anchor may comprise activating the anchor to secure the milling assembly within the tubing. This may position the mill guiding device in the tubing, for subsequent use in guiding the milling apparatus to form the window. The step of operating the annular seal element may comprise activating the annular seal element to seal an annular region defined between an internal wall of the tubing and an external surface of the milling assembly. The step of operating the combination anchor and annular seal element may comprise activating it to secure the milling assembly within the tubing and seal an annular region defined between an internal wall of the tubing and an external surface of the milling assembly.

The step of milling the window may be performed following operation of the anchor, annular seal element or combination anchor and annular seal element. The method may comprise: transmitting the fluid in the chamber to the device; and then releasing the milling apparatus from the mill guiding device and using the milling apparatus to mill the window, guided by the mill guiding device.

The method may comprise providing a plurality of fluid operated devices, and employing fluid in the internal chamber to operate the devices. For example, a separate anchor and annular seal element may be provided and both operated employing the fluid in the chamber.

Further features of the method of the fifth aspect of the invention may be derived from the text set out above relating to any one of the first to fourth aspects of the invention.

Embodiments of the present invention will now be described, with reference to the accompanying drawings, in which.

Figure 1:
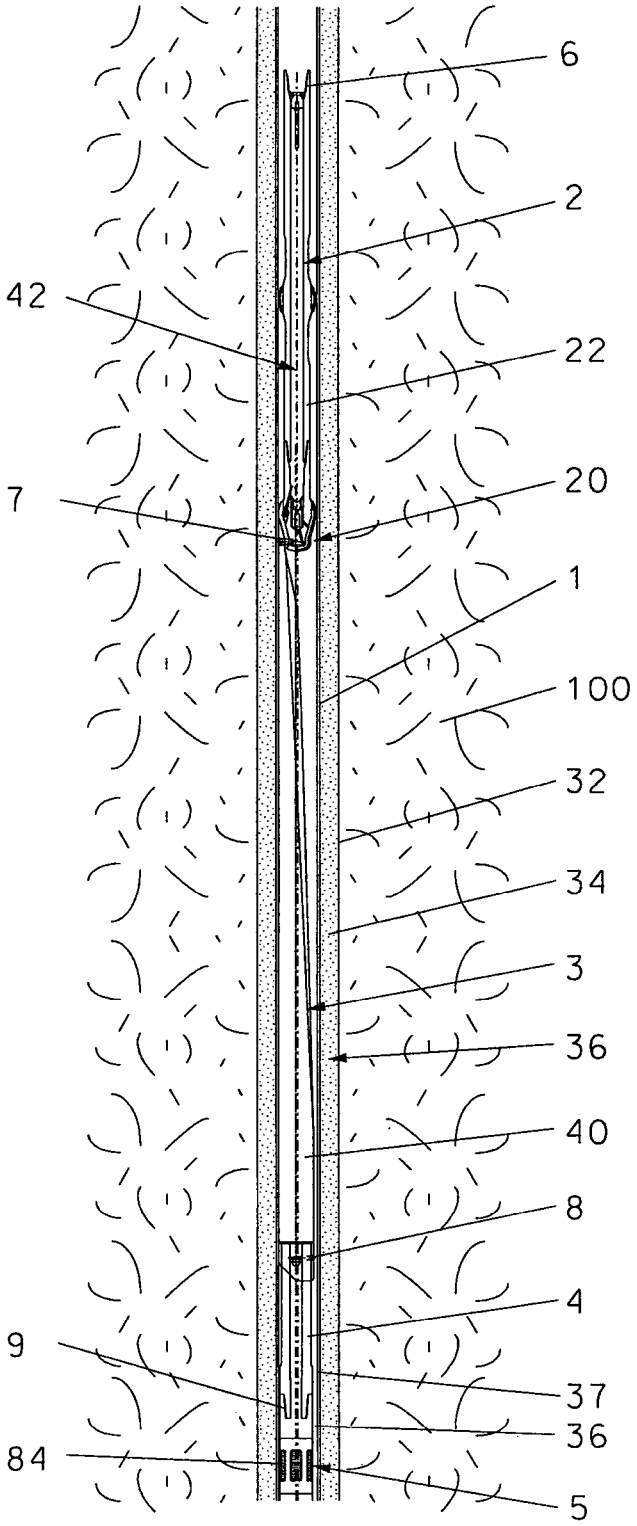
FIG. 1 is a schematic longitudinal sectional view of a milling assembly, comprising a milling apparatus, in accordance with an embodiment of the present invention.
Figure 2:
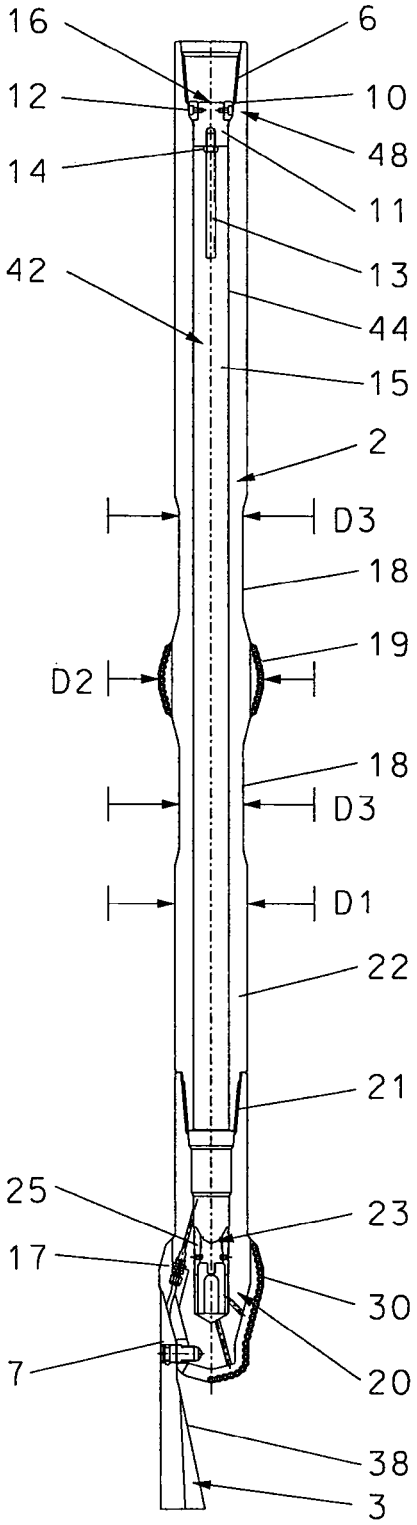
FIG. 2 is an enlarged view of the milling apparatus shown in FIG. 1.
Figure 3:
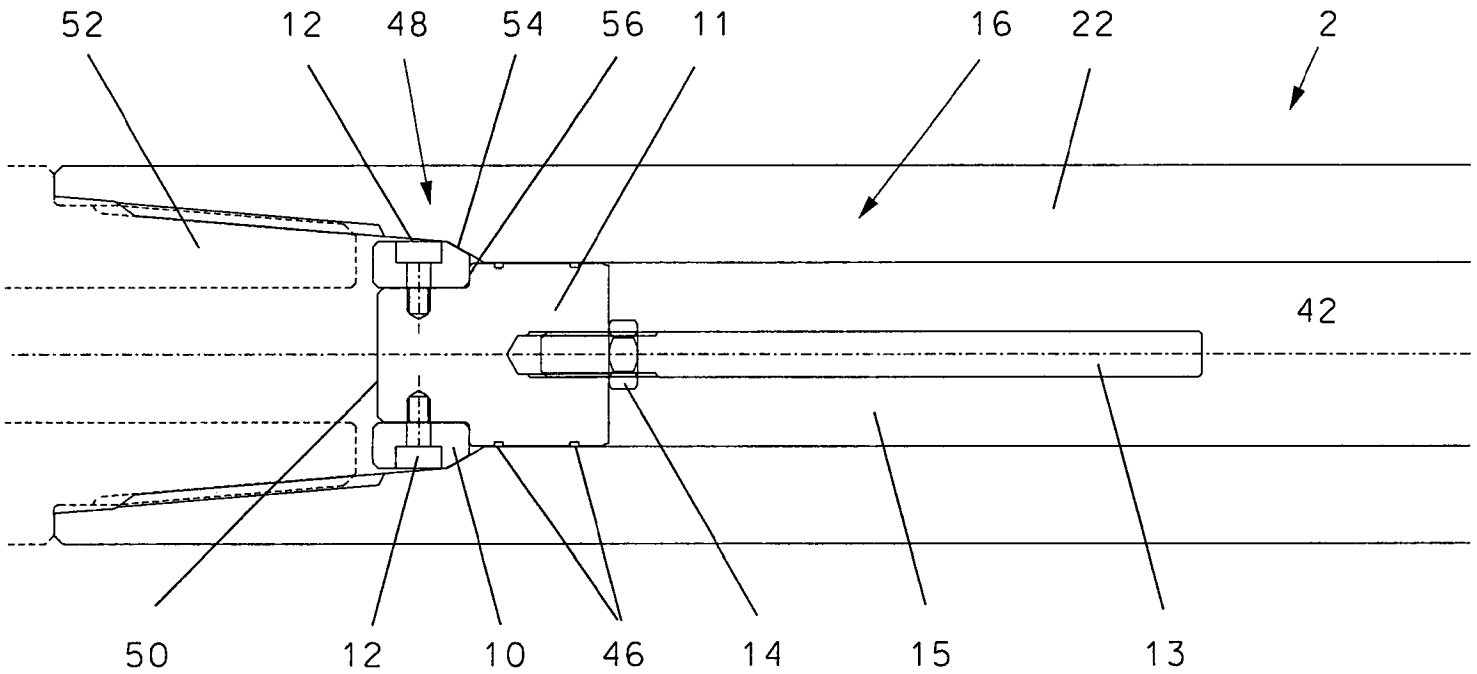
FIG. 3 is a further enlarged view of the milling apparatus of FIG. 1, showing a first seal assembly of the apparatus in a first position.
Figure 4:
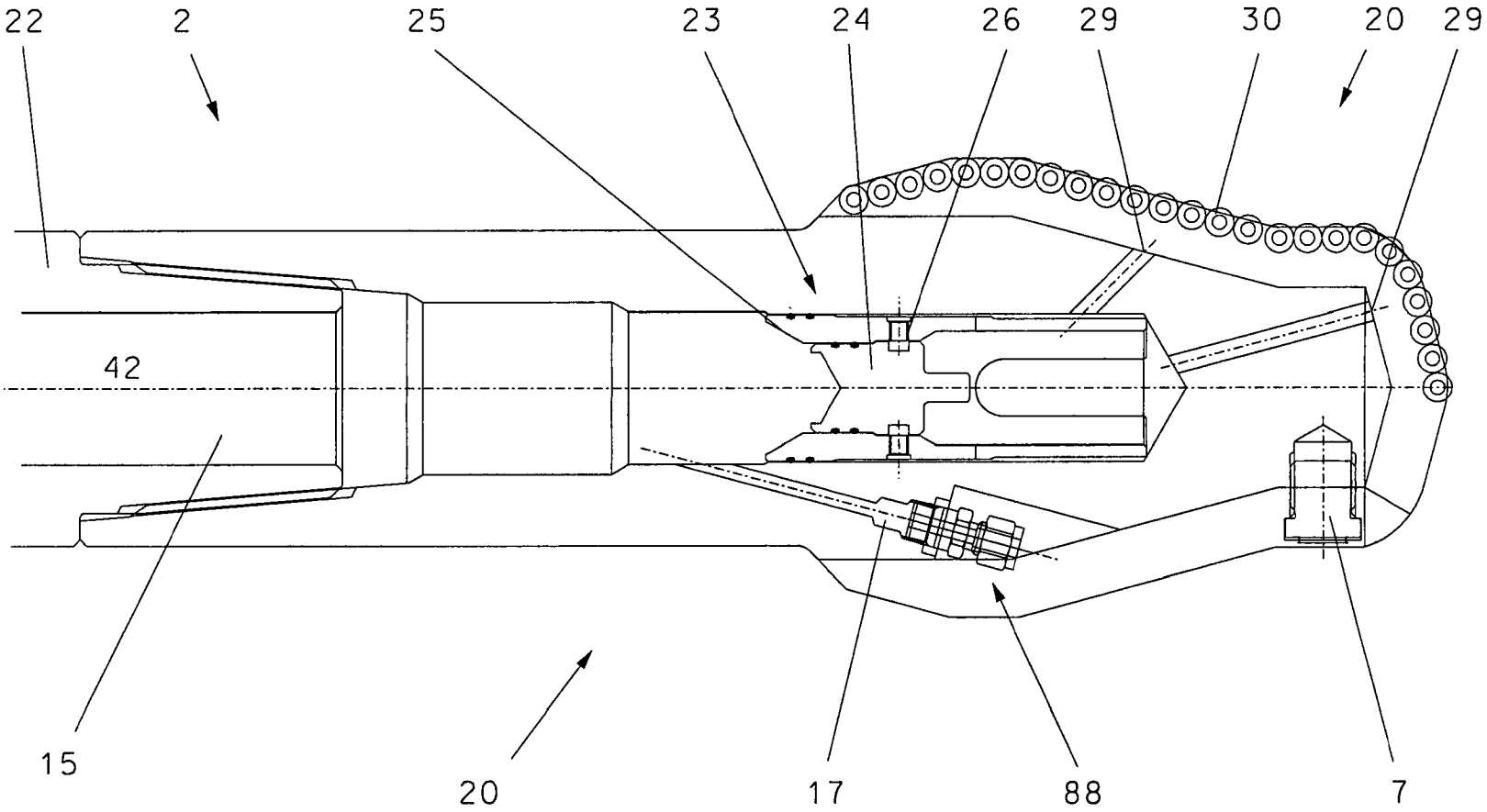
FIG. 4 is a further enlarged view of the milling apparatus of FIG. 1, showing a second seal assembly of the apparatus in a first position.
Figure 7:
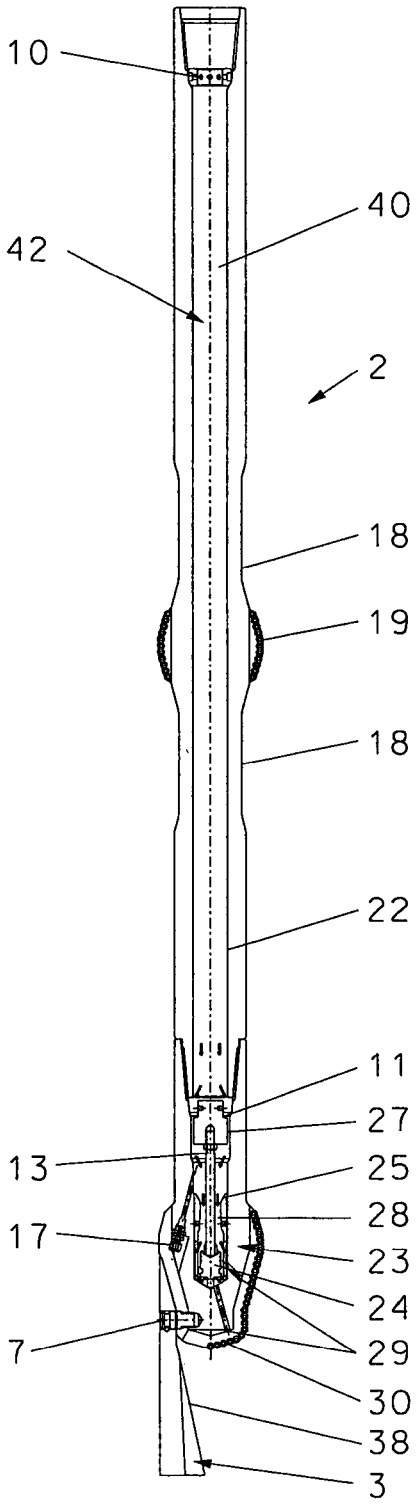
Figure 8:
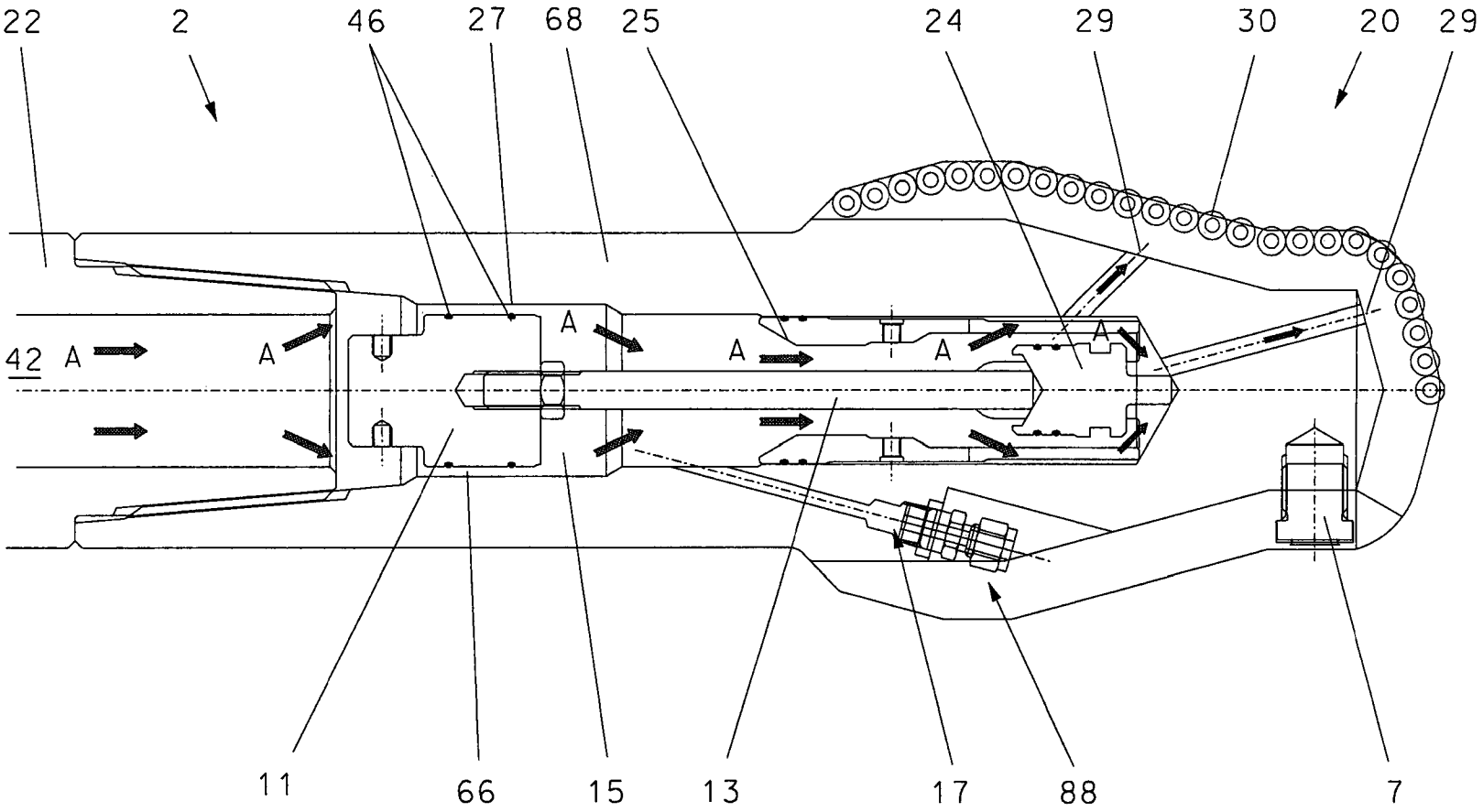
Figure 9:
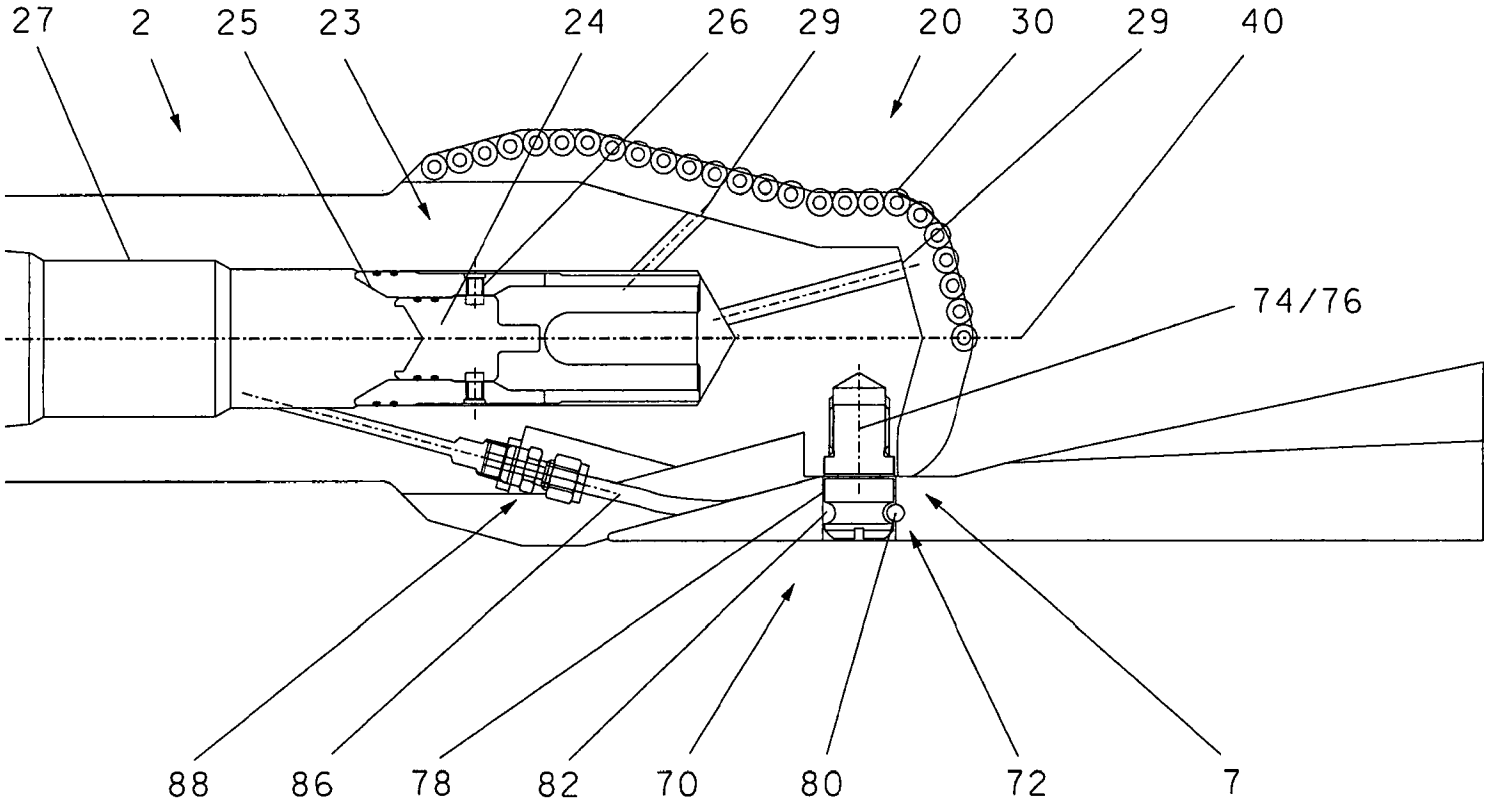
Figure 10:
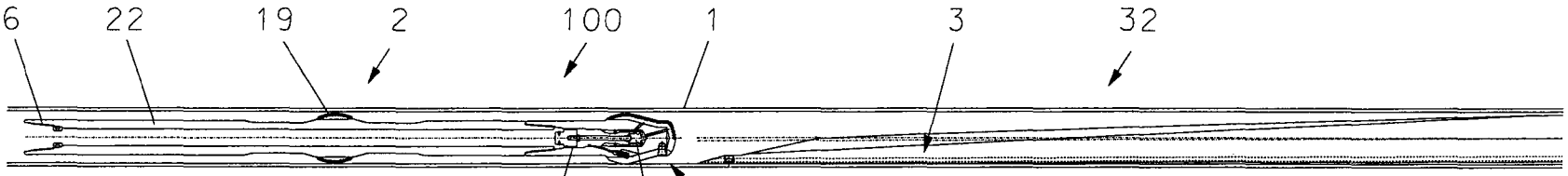
Figure 11:
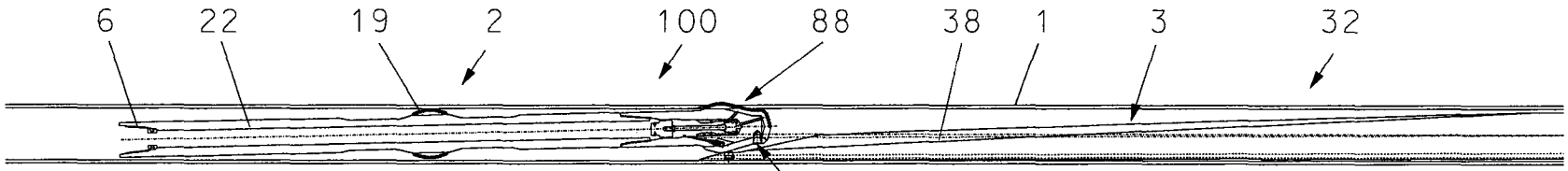
Figure 12:
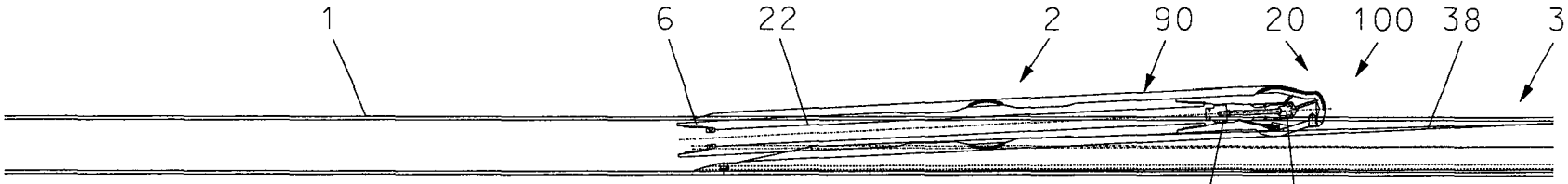

FIG. 7 (presented on same sheet as FIG. 5) is a view of the milling apparatus which is similar to FIG. 2, showing the first seal assembly of FIG. 3 in a third position, and the second seal assembly of FIG. 4 in a second position;

FIG. 8 is an enlarged view of the milling apparatus which is similar to FIG. 4, showing the first and second seal assemblies in the positions of FIG. 7;

FIG. 9 is a view of the milling apparatus which is similar to FIG. 4, showing further detail on a coupling between the milling apparatus and the mill guiding device; and FIGS. 10, 11 and 12 are views of the milling assembly of FIG. 1, showing steps in a method of forming a branch or lateral wellbore employing the milling assembly.

Turning firstly to FIG. 1, there is shown a milling assembly in accordance with an embodiment of the present invention, the milling assembly indicated generally by reference numeral 100. The milling assembly 100 comprises a milling apparatus, indicated generally by reference numeral 2, and which is shown in more detail in the enlarged view of FIG. 2. The milling apparatus 2 generally comprises a main body 22, a mill head 20 and an internal chamber 15 which can contain a fluid. The milling apparatus 2 can be arranged so that fluid contained in the chamber 15 is isolated from fluid external to the chamber, and is operable to transmit fluid contained in the chamber 15 to a fluid operated device 5 associated with the milling apparatus, to operate the device. The fluid which is to be provided in the chamber 15 will typically be a dedicated 'setting fluid', of a type used to operate (or 'set') the device 5.

FIG. 1 shows the milling assembly 100 positioned within a borehole or wellbore 32 which has been drilled from surface and lined with wellbore-lining tubing, in the form of a casing 1. The casing 1 has been cemented in place within the wellbore employing cement 34, supplied into an annular region 36 defined between a wall of the wellbore 32 and the casing 1, in a fashion known in the art. As will be described below, the milling assembly 100 and milling apparatus 2 of the present invention have a particular use in the formation of a window in the casing 1, as a preparatory step to the formation of a branch or lateral wellbore, extending from the main wellbore 32.

In the illustrated embodiment, the fluid operated device 5 may take the form of an anchor which serves for anchoring the milling assembly 100 within the casing 1, or a packer/plug which serves both for anchoring the milling assembly and sealing an annular region 36 defined between an inner wall 37 of the casing 1 and an external surface of the milling assembly 100. As is well known in the art, an anchor typically comprises fluid actuated anchor elements which engage the casing wall 37 to anchor the assembly 100, whereas a packer comprises an annular sealing element (not shown) which, when actuated, engages and seals against the casing wall 37. The packer may also serve for anchoring the assembly 100. Whilst particular reference is made to an anchor/packer/plug, it will be understood that the milling apparatus of the present invention may be used to actuate other fluid operated devices which can be deployed downhole.

The milling assembly 100 also comprises a mill guiding device in the form of a whipstock 3, which has a hardened face 38 which is inclined relative to a main axis 40. As is again well known in the art, the whipstock 3 serves for deflecting the milling apparatus 2 out through the wall of the casing 1, to form the required window. The packer 5 serves particularly for locating the whipstock 3 at the required position within the casing 1, which is verified using suitable sensors and by transmission of data to surface, such as via an MWD tool provided as part of the assembly 100 which is run-into the wellbore 32.

The milling apparatus 2 of the present invention addresses problems associated with prior milling apparatus of the type described above. In particular, it is not necessary to provide a separate setting tool, for operating the packer 5. Also, the fluid contained within the internal chamber 15, which is to be transmitted to the packer 5 to actuate it, is isolated from fluid external to the chamber. This helps to avoid contamination of the fluid in the chamber 15 prior to its being supplied to the packer 5. This is important because the fluid external of the chamber will often be a drilling fluid which contains abrasive solids particles that could damage the packer 5, and/or which could result in incorrect operation of the packer, if it becomes exposed to the drilling fluid. In addition, other abrasive solids such as drill cuttings may be present in the wellbore 32. Isolating the fluid in the chamber 15 from the external fluid prevents contamination of the fluid in the chamber by such abrasive solids, which could otherwise hamper operation of the packer 5.

The milling apparatus 2 and milling assembly 100 of the present invention will now be described in more detail, with reference also to FIGS. 3 to 12.

The milling apparatus 2 comprises an internal void, which is indicated generally by reference numeral 42, and which takes the form of an internal bore of the apparatus. The internal bore 42 extends through the main body 22 and the mill head 20. In the illustrated embodiment, the mill head 20 is provided as a separate component, coupled to the body 22. It will be understood, however, that the mill head 20 may be provided integrally with the body 22, as will be discussed below. The internal bore 42 therefore extends along the length of the main body 22, to define a flow path for fluid through the body. The internal bore 42 defines part of the internal chamber 15, as will now be described.

The milling apparatus 2 also comprises a first seal assembly, in the form of a first or upper/uphole piston assembly 16, which is shown in the enlarged view of FIG. 3. The upper piston assembly 16 is disposed within the bore 42 and sealed relative to the main body 22. The apparatus 2 also comprises a second seal assembly, in the form of a second or lower/downhole piston assembly 23, which is shown in the enlarged view of FIG. 4. The lower piston assembly 23 is also disposed within the bore 42 and sealed relative to the main body 22. The internal chamber 15 is the portion of the bore 42 defined between the upper and lower piston assemblies 16, 23 and a wall 44 of the main body 22, which forms a boundary of the bore. Fluid communication along the bore 42 past the upper and lower piston assemblies 16 and 23 is restricted, when the piston assemblies are in the positions shown in FIG. 1. In this way, the fluid contained within the chamber 15 is isolated.

The upper piston assembly 16 comprises a piston 11 which is translatable relative to the main body 22 within the bore 42, in a direction towards the lower piston assembly 23. Such translation of the piston 11 serves to transmit the fluid contained within the chamber 15 from the milling apparatus 2 to the packer 5, to set the packer. The piston 11 is arranged in sealing contact with the main body 22, and comprises a pair of seals, in the form of O-rings 46, which provide a wiping seal between the piston 11 and the main body 22 during translation of the piston. Other suitable seals may be employed, such as a packing set. The piston 11 is translatable between a first or starting position shown in FIG. 1, in which the piston 11 is spaced along the main body 22 from the lower piston assembly 23, and a second or setting position, in which the piston 11 is disposed closer to the lower piston assembly 23. The piston 11 is shown in its second position in FIG. 5, which is a view of the milling apparatus 2 similar to FIG. 2. In its second position, the piston 11 actually contacts the lower piston assembly 23, as best shown in the further enlarged view of FIG. 6.

The piston 11 is retained in its first position by a retaining arrangement 48, which comprises a number of retaining elements in the form of shear screws, two of which are shown and given the reference numeral 12. The shear screws 12 prevent translation of the piston 11 until such time as a sufficiently large release force is applied to the upper piston assembly 16. This is achieved by applying a fluid pressure force to the piston 11, by increasing the pressure of fluid in the bore 42 uphole or upstream of the piston. The shear screws 12 are rated to shear at a determined, applied pressure imparted on a face 50 of the piston 11.

The retaining arrangement 48 also comprises a retaining member in the form of a generally annular retainer ring 10, which is secured to the piston 11 by the shear screws 12. The retaining ring 10 has an outer diameter which is greater than a diameter of the portion of the bore 42 along which the piston 11 travels. In this way, the retainer ring 10 initially prevents translation of the piston 11 relative to the main body 22. Application of sufficient fluid pressure force on the piston 11 shears the screws 12, releasing the piston 11 from the retaining ring 10, so that it can translate relative to the main body 22.

The retainer ring 10 is arranged to prevent movement of the piston 11 in an uphole direction. This is achieved by sandwiching the retaining ring 10 between an end of a connector, shown in broken outline and indicated by numeral 52, and a tapered shoulder 54 defined by the main body 22. The connector 52 is provided on a tubular member (not shown) which is coupled to the milling apparatus 2, and which forms part of a work or drill string that serves for deploying the apparatus 2 into the wellbore 32. The piston 11 comprises an abutment surface, such as a shoulder 56, which cooperates with the retaining ring 10 to effectively prevent uphole movement.

During translation of the piston 11 along the bore 42 towards the lower seal assembly 23, the fluid contained within the chamber 15 is urged out of the chamber, through a communication or setting port 17 which communicates with the chamber 15 and with the packer 5. The setting port 17 is defined by the main body 22, and is located at a position which is upstream or uphole of the lower piston assembly 23, and downstream or downhole of the upper piston assembly 16. In this way, during translation of the piston 11 towards the lower piston assembly, and when the piston 11 is in sealing contact with the main body 22, fluid in the chamber 15 is directed out through the port 17. The fluid transmitted to the packer 5 acts to set the packer, to anchor/seal the packer (and so the assembly 100) within the casing 1, as described above.

The lower piston assembly 23 similarly includes a (circulation) piston 24 which is translatable within the bore 42 between a first or closed position, shown in FIGS. 1 to 6, and a second or open position shown in FIG. 7 (which is a view similar to FIG. 2). The lower piston assembly is best shown in its open position in the enlarged view of FIG. 8. In its first position, the lower piston 24 is effectively in sealing contact with the main body 22, closing the bore 42 and so restricting fluid flow along the bore. In its second position, the piston 24 is out of sealing contact with the main body 22. Movement of the lower piston 24 from its first to its second position thus permits the flow of fluid along the bore 42, past the lower piston assembly 23. In this way and following transmission of the fluid in the chamber 15 to the packer 5, the bore 42 can be opened up so that fluid can flow along the bore and out of the milling apparatus 2.

The lower piston 24 is translated to its second position under the action of the upper piston 11. Specifically, contact between the upper piston 11 (when in its second position of FIGS. 7/8) and the lower piston 24 facilitates the application of force to move the lower piston to its second, open position. To this end, the upper piston assembly 16 comprises a shear prong 13, which contacts the lower piston 24 to move it to the open position. The shear prong 13 is releasably coupled to the upper piston 11, for movement therewith, via a lock nut 14.

The lower piston 24 is initially retained in its first position by a retaining arrangement, indicated generally by reference numeral 58. The retaining arrangement 58 comprises a number of retaining elements in the form of shear screws, two of which are shown and given the reference numeral 26. The shear screws 26 prevent translation of the lower piston 24 until such time as a sufficiently large release force is applied. The shear screws 26 are rated to shear at a determined applied force imparted on the lower piston 24, via the shear prong 13 coupled to the upper piston 11. This is achieved by fluid pressure acting on the upper piston face 50. Typically, the shear screws 26 securing the lower piston 24 will be rated to shear at a higher applied force (and so fluid pressure) than the upper shear screws 12. In this way, when the fluid pressure is raised to release the upper piston 11 from the retaining ring 10, urging the piston downhole and into contact with the lower piston 24, the upper piston 11 will not initially apply sufficient force to the lower piston 24 to shear the screws 26. The increased pressure which results when the upper piston prong 13 comes into contact with the lower piston 24 is detected at surface, and the pressure can then be further raised to shear the lower screws 26 and release the lower piston 24.

The lower retaining arrangement 58 also comprises a retaining member in the form of a generally annular (circulation) sleeve 25, which is initially secured to the lower piston 24 via the lower shear screws 26. The sleeve 25 is secured against movement within the bore 42, and sealed within the bore via O-ring seals 60 (or similar), which seal between the piston 24 and the sleeve 25. Translation of the lower piston 24 relative to the main body 22 is thus initially prevented, and the piston is effectively in sealing contact with the main body (via the sleeve 25). Application of sufficient force to the lower piston 24 releases it from the sleeve 25, so that it can translate relative to the main body 22. The sleeve 25 prevents movement of the lower piston 24 in an uphole direction through an abutment surface, defined by a shoulder 62, which cooperates with a corresponding shoulder 64 on the piston 24.

In order to move the lower piston 24 to its second position, the upper piston 11 is movable between its second position, in which it remains in sealing contact with the main body 22, and a third or open position, in which it is out of sealing contact with the main body. Such movement of the upper piston 11 permits the flow of fluid along the bore 42 past the piston, as shown in the enlarged view of FIG. 8. The upper piston 11 translates the lower piston 24 from its closed position to its open position, when it moves to its third position. This opens up the bore 42 for the flow of fluid therethrough. To facilitate this, the bore 42 comprises an enlarged diameter portion or recess 27 which receives the upper piston 11, when in its third position. In the illustrated embodiment, the recess is defined within a body 68 of the mill head 20, but may be defined by the main body 22, where the mill head is integral. A spacing in the form of an annular channel 66 is defined between an internal wall of the body 68 defining the recess 27 and an external surface of the upper piston 11, along which fluid can flow.

The milling apparatus 2 also comprises at least one flow port, and in the illustrated embodiment, comprises a plurality of flow ports, two of which are shown and given the reference numeral 29. The flow ports 29 are in the mill head 20, and can be arranged to communicate with the chamber 15 so that fluid can flow through the chamber and out of the apparatus 2. When the lower piston 24 is in its closed position (FIGS. 1 to 6), the flow ports 29 are out of communication with the chamber 15, so that the fluid in the chamber is isolated from fluid external to the chamber. The flow ports 29 remain isolated until after the fluid in the chamber 15 has been transmitted from the chamber to the packer 5. Advantageously, and in contrast to prior apparatus employing knock-off plugs, the number of flow ports 29 which can be provided is less restricted. Consequently, the total flow area of the ports 29 is greater than in prior apparatus, with consequent benefits in terms of fluid flow.

Communication between the flow ports 29 and the chamber 15 is only achieved when the lower piston 24 is in its open position (FIGS. 7 and 8), so that fluid can flow through the chamber and out of the apparatus 2, along the bore 42. Advantageously, this avoids a requirement to provide, for example, knock-off plugs to close the flow port 29, which is undesirable. When the upper piston 11 is in its third position, and the lower piston 24 in its open position, a flow path is defined (by a void 28) which extends along the bore 42 between the wall 44 of the main body 22 and an outer surface the upper piston 11, and between the wall of the main body and an outer surface of the lower piston 24. This is illustrated by the arrows 'A' in FIG. 8. A minimum flow area of the flow path is greater than a total flow area defined by the flow ports 29, so that the presence of the pistons 11 and 24 in the bore 42 does not provide an increased resistance to flow, beyond that provided by the ports 29 themselves.

The mill head 20 is provided at a leading end of the milling apparatus 2, and the apparatus comprises a secondary or follow mill 19, which is spaced along a length of the apparatus 2 from the mill head 20. The follow mill 19 serves for smoothing an edge of a window which is formed in the casing 1 by the mill head 20. The follow mill 19 is provided on the main body 22. A majority of the main body 22 is of a first outer diameter $D_1$, and the follow mill 19 extends from the main body 22 to describe a larger second outer (milling) diameter $D_2$. Portions 18 of the main body 22 adjacent the follow mill are of a reduced third diameter $D_3$ which is less than the first diameter $D_1$, and define flex areas. These facilitate flexure of the milling apparatus 2, in the region of the follow mill 19, when the apparatus is deflected out from the main wellbore 32 to drill a lateral or branch wellbore.

Turning now to FIG. 9, a coupling between the milling apparatus 2 and the whipstock 3 is shown. The milling assembly 2 comprises a releasable connection between the milling apparatus and the whipstock 3, the connection indicated generally by reference numeral 70. The connection 70 is arranged to facilitate flexure of the milling apparatus 2 relative to whipstock 3. The connection 70 comprises a shearable retaining element, in the form of a break bolt 7. The break bolt 7 is mounted to one of the milling apparatus 2 and the whipstock 3, and in this case is mounted to the whipstock, via a deflectable mounting 72. The deflectable mounting 72 facilitates deflection of the break bolt 7 about a connection axis 74 extending between the milling apparatus 2 and the whipstock 3, and which is oriented generally perpendicular to the main axis 40. The break bolt 7 is deflectable to a position in which an axis 76 of the bolt is disposed transverse to the connection axis 74. This facilitates the flexure, which may occur during running-in of the assembly 100, for example where the main wellbore 32 is deviated from the vertical. The break bolt 7 is disposed in a mounting bore 78 in the whipstock 3, and the deflectable mounting 72 comprises a retaining component in the form of a dowel 80 which engages the break bolt in such a way that the deflection is permitted. The retaining dowel 80 engages in a groove or recess 82 extending around a perimeter of the portion of the break bolt 7 disposed in the mounting bore 76, the dowel and groove being dimensioned to allow the required movement of the bolt within the bore.

As shown in FIG. 1, a hinge component 4 is provided downhole of the whipstock 3, connected to the whipstock via a hinge pin 8. This provides flexibility in the connection between the whipstock 3 and the packer 5. The packer 5 comprises an internal chamber, indicated schematically by the numeral 84, which can communicate with the internal chamber 15 in the milling apparatus 2. In this way, when the milling apparatus 2 is operated to transmit fluid from its chamber 15 to the packer 5, the fluid is transmitted to the internal chamber 84 of the packer. In this way, the fluid remains isolated from fluid external to the chambers 15 and 84, restricting the likelihood of contamination. A control or communication line 86 extends between the chambers 15 and 84. A releasable connection 88 is provided between the communication line 86 and the milling apparatus 2, to facilitate release of the milling apparatus from the whipstock 3. The communication line 86 extends through the whipstock 3 to the packer 5, and the whipstock defines an internal passage (not shown) which receives or defines at least part of the communication line. However, the communication line 86 may be provided separately and coupled to the whipstock.

Operation of the milling assembly 100 to form a branch or lateral wellbore will now be described, with reference to FIGS. 10, 11 and 12, which illustrate steps in the method.

As discussed above, FIG. 1 shows the complete assembly 100 located within the casing 1 from which a multilateral exit is to be produced. The milling apparatus 2, whipstock 3, and hinge 4 are shown, the hinge being attached to the packer or plug 5, only the top connection of which is shown. The milling apparatus 2 is attached to a work string (not shown) used to deploy the assembly 100 via a threaded connection 6.

The milling apparatus 2 is attached to the whipstock 3 by means of the break bolt 7, which is threaded to the mill head 20 and pinned to the whipstock. The whipstock 3 is attached to the hinge connector 4 by means of the hinge pin 8, the hinge pin being designed to provide flexibility to the whipstock, allowing it to pivot back against the casing wall 37, and also to break in double shear should the whipstock 3 need to be retrieved at a later date. The hinge connector 4 is attached the packer or plug 5 via a threaded connection 9.

The assembly 100 is run in-hole and orientated using any number of means known to those skilled in the art, and it is on completion of this operation that the invention is then employed.

FIG. 2 shows the milling assembly 2 as it would be run into well. When the workstring is attached to the milling assembly 2 by means of the upper connection 6, the nose (connector 52) of a workstring pin thread traps the upper piston retainer ring 10 within the bore 42 of the milling assembly 2. To this piston retainer ring 10, the setting piston 11 is fitted and located in place with the shear screws 12. These shear screws 12 will typically be cap head screws which are threaded into the setting piston 11. By doing this, once sheared, the head of the screw is retained within the piston retainer ring 10 and the lower portion of the screw is retained within the setting piston 11. The shear prong 13 is threaded into the setting piston 11 and locked in place via the lock nut 14. When a predetermined pressure is applied, the setting piston 11 will shear from the piston retainer ring 10 and the setting sequence will commence.

The chamber 15 of the milling apparatus 2 is filled with a suitable hydraulic (setting) fluid to facilitate setting of the packer or plug 5. The filling of this chamber 5 can be achieved in several ways that is, physically filling the bore of the milling apparatus 2 prior to the installation of the upper setting piston assembly 16, or via the setting port 17.

The two flex areas 18 either side of the follow mill 19 are designed to clean up the milled window profile produced by the mill head 20. The flex areas 18 provide two benefits: a) they allow flex during the milling operation, reducing stiffness of the milling assembly 100 and also reducing stress within the mill as it travels up the whipstock 3 and out of the milled window; and b) they reduce the wear typically experienced when the follow mill 19 reaches the start of the milled window and the body of the milling apparatus 2 rubs against the window edge, which could otherwise produce radial gouges around the circumference of the mill body 22 and introduce stress raisers.

In this particular illustration the mill is shown with a threaded connection 21 between the mill body 22 and the mill head 20. This connection facilitates the assembly of the lower piston assembly 23, in that it enables easy access to portion of the bore 42 defined by the mill head 20. However, it is possible to weld the mill head 20 to the mill body 22, which would mean assembling the lower piston assembly 23 from the top end of the milling apparatus 2, through the upper connection 6.

Figure 5:
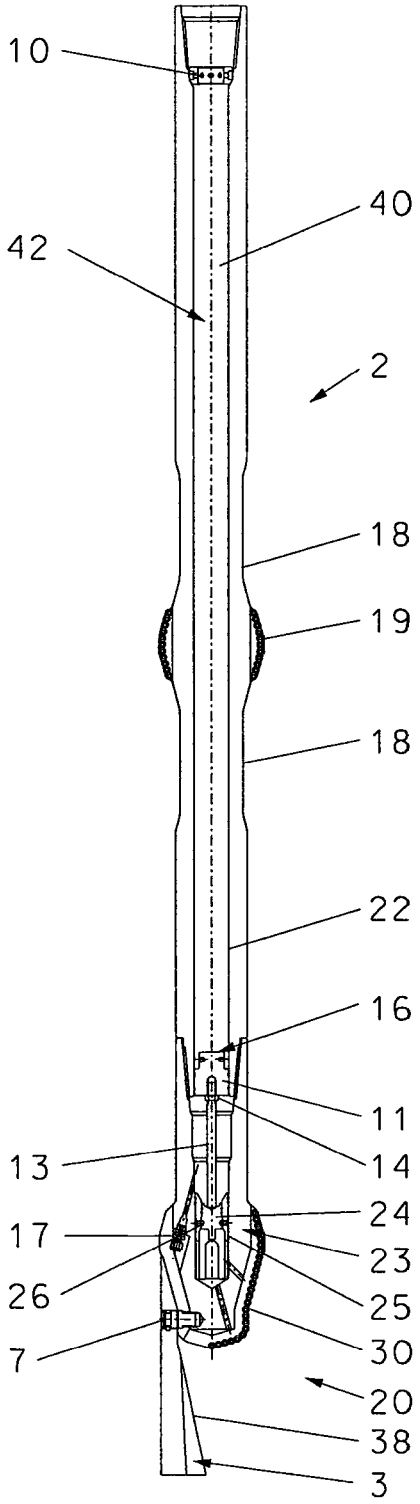
FIG. 5 is a view of the milling apparatus which is similar to FIG. 2, showing the first seal assembly of FIG. 3 in a second position.
Figure 6:
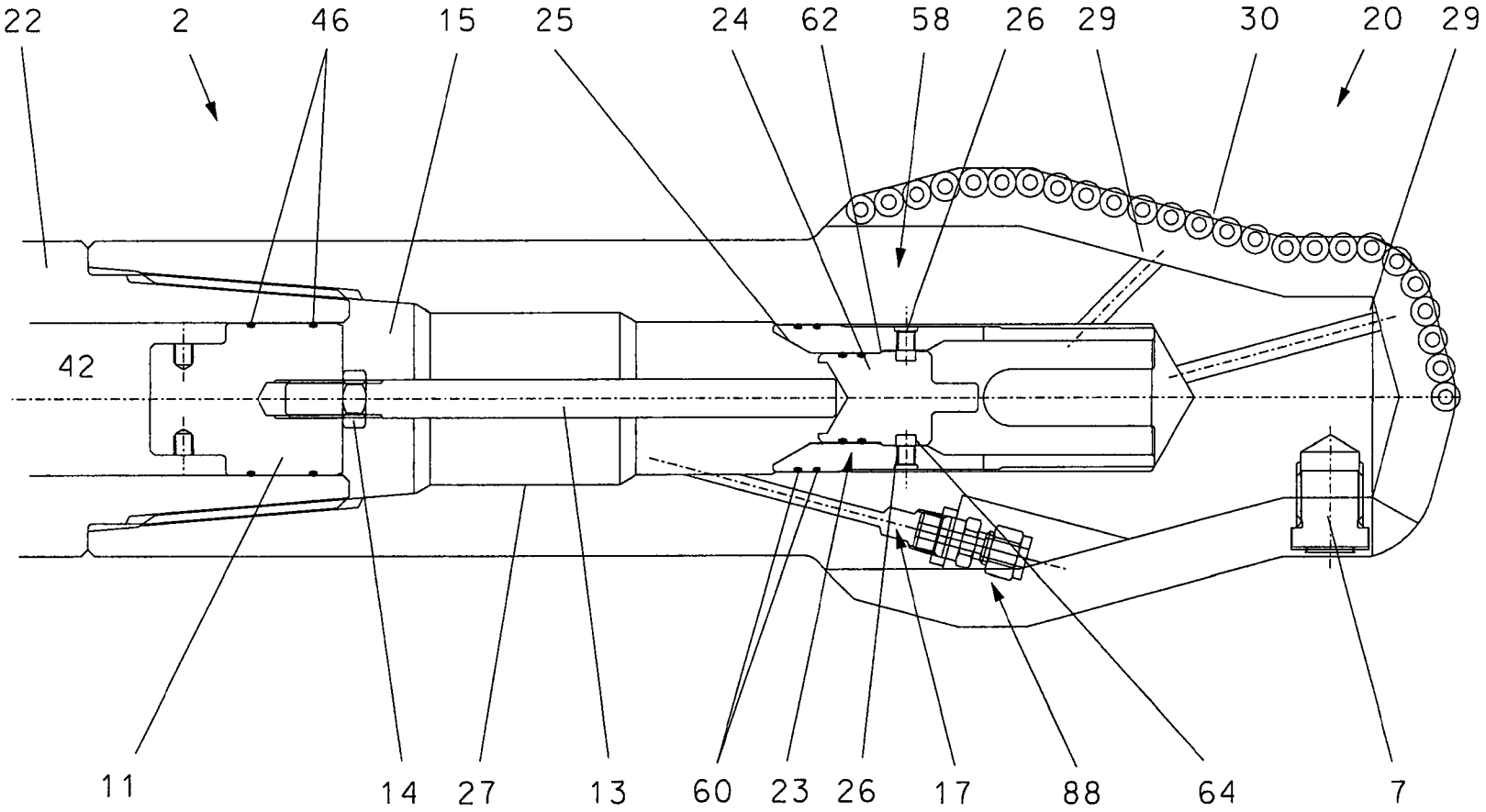
FIG. 6 is an enlarged view of the milling apparatus which is similar to FIG. 4, showing the first seal assembly in the position of FIG. 5.

FIGS. 5 and 6 show the setting piston assembly 16 after the upper piston 11 has been sheared from the piston retainer ring 10, with shear prong 13 contacting the lower, circulation piston 24. At this point almost all of the hydraulic setting fluid 15 has been displaced from the chamber 15 through the setting port 17, through the control line (or hydraulic hose) 86 to the packer or plug 5. The circulation piston 24 is located in place by the circulation sleeve 25, and is secured to the circulation sleeve by the shear screws 26.

At this point a rise in applied hydraulic pressure would become evident at surface when the shear prong 13 has contacted the circulation piston 24. Or, a pressure increase at surface would be evident that the packer/plug 5 had set. Either way, increasing the pressure within the work string will result in the shear screws 26 shearing, and continued pumping will drive down the setting piston 11.

FIGS. 7 and 8 show the circulation piston 24 bottomed out within the bore of the mill head 20, and the setting piston 11 sitting down inside the recess 27 within the bore of the mill head 20. This recess 27 permits flow to bypass the setting piston, travelling in the void flow path 28 between the shear prong 13 and the circulation sleeve 25, and out of the circulation ports 29, which are situated between the cutting structures of mill blades 30. At this point any excess setting fluid is pumped out of the bore 42, permitting the drilling medium (mud/water) to flow freely through the apparatus 2 and out through the circulation ports 29 (for cooling the mill head 20 and transporting cuttings to surface).

The break bolt 7 can now be sheared by applying an axial load to the workstring. This can be done either as soon as the packer/anchor 5 is set or after circulation is achieved. FIG. 10 shows the assembly 110 following shearing of the break bolt 7. The milling apparatus 2 can then be translated downhole, travelling along the whipstock face 38 and into contact with the casing 1, whereupon it starts to mill the casing to form a window 88, as shown in FIG. 11. Further translation of the milling apparatus 2 extends the window 88, and commences the formation of a branch or lateral wellbore 90, which communicates with the main wellbore 32. As discussed above, the follow mill 19 smooths the window 88 edge to restrict damage to the mill main body 22. The lateral wellbore 90 is then extended, lined and cemented and the main wellbore 32 reopened, following conventional techniques.

Certain features of the present invention, and advantages which the present invention provides over prior milling assemblies and apparatus are as follows.

The features of the disclosed design negate the need for a separate running tool and provide a chamber of clean hydraulic fluid contained within the milling apparatus which is isolated from the drilling fluid within the work string and the well fluid external to the apparatus. The mill may contain an upper and lower piston assembly, both of which can be pinned in place with shear screws, but which could equally be fixed with another suitable shear mechanism. The upper piston assembly may consist of a piston retainer ring, which may be trapped between an upper connection and a drill or work string, a setting piston which may be pinned to the piston retainer ring with shear screws and, using O-rings (or possibly a packing set), provides a seal within the bore of the milling apparatus. A shear prong fitted to the setting piston can be locked in place with a lock nut. The lower piston assembly can sit within the mill head and may comprise a circulation sleeve which seals within the bore of the mill head, inside which is located the circulation piston, which can be pinned in place using shear screws and thus can block off the entire bore of the milling apparatus to well fluid which is present below this piston on account of open circulation ports in the mill head. A (single) port can be located just above this piston assembly which provides a communication path via a control line of hydraulic hose between the contained hydraulic fluid within the mill and the packer or plug located below the whipstock.

The fitting of the lower piston inside the mill head can be achieved more easily by having a threaded connection between the main body of the mill and the mill head, however the concept could still be achievable if a welded connection was used. The mill can be attached to the face of the whipstock by means of a calibrated shear bolt. This bolt can be threaded into the mill head and pinned to the whipstock via a dowel or roll pin, providing a degree of flexibility between the milling apparatus and whipstock in order to avoid subjecting the bolt to unnecessary stresses prior to running in hole. The hydraulic communication between the contained hydraulic fluid in the milling apparatus and the packer or plug may be permitted via the whipstock by either a, milled channel and control line fitted to the whipstock, or by means of a hydraulic hose and a gun drilled hole through the whipstock.

A primary advantage is that this invention provides several ports in the mill head for circulation without the need of fitting knock off plugs. By their design knock off plugs are limited as to the number that can be fitted to a mill head, i.e. the more there are, the more foreign objects are present when milling commences. Therefore, because of the low number of plugs it equates to a reduced flow are out of the mill head. The present invention does not limit the amount of circulation ports and therefore does not restrict the flow area as a result. Multiple ports in numerous locations can be designed into the mill head.

Another feature of this invention is that it effectively incorporates a setting tool inside the body of the milling apparatus, providing a means of containing hydraulic fluid without the need of additional tools or equipment. The current design is also flexible in that it could be run without the upper piston if no clean setting fluid was required, or if not being used on a hydraulic whipstock application none of the pistons need be fitted and it can be used as a regular milling apparatus.

The pinned upper piston may also allow MWD operations to be conducted prior to milling without affecting the whipstock. Also, bypass valves situated above the whipstock assembly can be repeatedly opened and closed without interfering with the mill and whipstock. It is only when a pressure is applied in excess of what the shear mechanism is set at that the upper piston will start to move and initiate the setting sequence of the packer or anchor.

The invention claimed is:

1. A milling apparatus comprising:

a main body comprising an internal bore defining a flow path through the body;

a mill head having at least one flow port;

an internal chamber which can contain a fluid, the internal bore of the main body defining at least part of the chamber;

a first seal assembly disposed within the internal bore;

a second seal assembly disposed within the internal bore; and a communication port extending through a wall of the milling apparatus between the internal chamber and an exterior of the milling apparatus, the communication port located at a position which is, in use, uphole of the second seal assembly;

in which the first and second seal assemblies are initially sealed relative to the main body, so that fluid communication along the internal bore past the first and second seal assemblies is prevented and fluid contained in the chamber isolated from fluid external to the chamber;

in which at least part of the first seal assembly is translatable within the internal bore in a direction towards the second seal assembly, to transmit fluid contained in the chamber through the communication port to a fluid operated device associated with the milling apparatus, to operate the device;

and in which the second seal assembly is a piston assembly comprising a piston which is translatable within the internal bore from a closed position in which the piston is in sealing contact with the main body and blocks the internal bore so that fluid is prevented from flowing along the internal bore past the piston and said flow port is out of communication with the chamber, to an open position in which the piston is out of sealing contact with the main body so that fluid can flow along the internal bore around an external surface of the piston and so out of the apparatus through said flow port.

2. A milling apparatus as claimed in claim 1, in which the internal chamber is the portion of the bore defined between the seal assemblies and a wall of the main body.

3. A milling apparatus as claimed in claim 1, in which the first seal assembly is an upper piston assembly comprising a piston which is translatable relative to the main body within the bore, the upper piston assembly arranged in sealing contact with the main body, and in which the second seal assembly is a lower piston assembly.

4. A milling apparatus as claimed in claim 1, in which at least part of the first seal assembly is translatable within the bore between:

a first position, in which said part of the first seal assembly is spaced along the main body from the second seal assembly; and a second position, in which said part of the first seal assembly is disposed closer to the second seal assembly, such movement acting to transmit the fluid contained in the chamber to the device.

5. A milling apparatus as claimed in claim 4 in which:

in the first position, said part of the first seal assembly is out of contact with the second seal assembly; and in the second position, said part of the first seal assembly contacts the second seal assembly.

6. A milling apparatus as claimed in claim 5, in which said part of the first seal assembly is retained in the first position by a retaining arrangement comprising at least one retaining element which prevents translation of said part of the seal assembly until such time as a sufficiently large release force is applied to the seal assembly.

7. A milling apparatus as claimed in claim 6, in which the retaining arrangement comprises a retaining member which is secured to said part of the seal assembly via the retaining element, the retaining member having an outer dimension which is greater than a dimension of a main part of the bore, so as to initially prevent translation of said part of the seal assembly relative to the main body.

8. A milling apparatus as claimed in claim 7, in which the retaining member is arranged to prevent movement of said part of the first seal assembly in an uphole direction.

9. A milling apparatus as claimed in claim 4, in which the part of the first seal assembly which is translatable relative to the main body is arranged to move the piston of the second seal assembly from the first position to the second position.

10. A milling apparatus as claimed in claim 4, in which said part of the first seal assembly is movable between:

the second position, in which said part of the first seal assembly is in sealing contact with the main body; and a third position, in which said part of the first seal assembly is out of sealing contact with the main body, such movement permitting the flow of fluid along the bore past the first seal assembly.

11. A milling apparatus as claimed in claim 10, in which the first seal assembly is arranged to translate the piston of the second seal assembly from its closed position to its open position, when it moves to the third position, to open up the bore for the flow of fluid therethrough.

12. A milling apparatus as claimed in claim 11, in which the bore comprises an enlarged diameter portion which receives said part of the first seal assembly when in its third position, a spacing being defined between an internal wall of the portion of the milling apparatus defining the enlarged dimension portion and an external surface of said part of the first seal assembly.

13. A milling apparatus as claimed in claim 10, in which when said part of the first seal assembly is in its third position, and the piston of the second seal assembly is in its open position, a flow path is defined which extends along the bore between a wall of the apparatus and an outer surface of said part of the first seal assembly, and between the wall of the apparatus and an outer surface of the piston of the second seal assembly.

14. A milling apparatus as claimed in claim 13, in which a minimum flow area of said flow path is greater than a total flow area defined by the at least one flow port.

15. A milling apparatus as claimed in claim 1, in which the piston of the second seal assembly is retained in the closed position by a retaining arrangement comprising at least one retaining element which prevents translation of the piston until such time as a sufficiently large release force is applied to the seal assembly.

16. A milling apparatus as claimed in claim 15, in which the retaining arrangement comprises a retaining member which is secured to the piston of the seal assembly via the retaining element, the retaining member being secured against movement relative to the main body so as to initially prevent translation of the piston relative to the main body.

17. A milling apparatus as claimed in claim 16, in which the retaining member prevents movement of the piston of the second seal assembly in an uphole direction.

18. A milling apparatus as claimed in claim 1, in which the communication port is located at a position which is downhole of the first seal assembly.

19. A milling apparatus as claimed in claim 1, in which:

the mill head is provided at a leading end of the milling apparatus;

the apparatus comprises a follow mill provided on the main body and spaced along a length of the apparatus from the mill head; and a main part of the main body is of a first outer diameter, the follow mill extends from the main body to describe a larger second outer diameter, and portions of the body adjacent the follow mill are of a reduced third outer diameter which is less than the first diameter.

20. A downhole assembly comprising:

a milling apparatus according to claim 1;

a mill guiding device which is releasably coupled to the milling apparatus, for guiding the milling apparatus out through a wall of the downhole tubing to mill a window; and a fluid operated device associated with the milling apparatus, operation of the device being controlled by the milling apparatus.

21. An assembly as claimed in claim 20, in which the fluid operated device is an anchor device which serves for anchoring the mill guiding device within the downhole tubing.

22. An assembly as claimed in claim 20, in which the fluid operated device is an annular sealing device for sealing an annular region defined between a wall of the sealing device and a wall of the tubing.

23. An assembly as claimed in claim 20, in which the fluid operated device comprises an internal chamber which can communicate with the internal chamber defined by the milling apparatus so that, when the milling apparatus is operated to transmit fluid from its chamber to the fluid operated device, the fluid is transmitted to the internal chamber of the device.

24. An assembly as claimed in claim 23, comprising a communication line extending between the chambers, a releasable connection being provided between the communication line and the milling apparatus, to facilitate release of the milling apparatus from the mill guiding device.

25. An assembly as claimed in claim 24, in which the communication line extends through the mill guiding device.

26. An assembly as claimed in claim 20, in which the milling assembly comprises a releasable connection between the milling apparatus and the mill guiding device, the releasable connection being arranged to facilitate flexure of the milling apparatus relative to the mill guiding device.

27. An assembly as claimed in claim 26, in which the releasable connection comprises a shearable retaining element mounted to one of the milling apparatus and the mill guiding device via a deflectable mounting which facilitates deflection of the retaining element about a connection axis extending between the milling apparatus and the mill guiding device.

28. An assembly as claimed in claim 27, in which the retaining element is deflectable to a position in which an axis of the element is disposed transverse to the connection axis.

29. An assembly as claimed in claim 27, in which the retaining element is disposed in a mounting bore in one of the milling apparatus and the mill guiding device, and the deflectable mounting comprises a retaining component which engages the retaining element in such a way that said deflection is permitted.

30. An assembly as claimed in claim 29, in which the retaining component is a retaining dowel which engages in a groove extending at least part way around a perimeter of the portion of the retaining element disposed in the mounting bore, the dowel and groove dimensioned to allow movement of the retaining element within the bore.

31. A method of milling a window in a downhole tubing, the method comprising the steps of:

running a milling assembly comprising a milling apparatus as claimed in claim 1, a mill guiding device releasably coupled to the milling apparatus, and a fluid operated device into a wellbore in which a downhole tubing has been located;

providing a fluid within an internal chamber of the milling apparatus, and arranging the milling apparatus so that the fluid in the chamber is isolated from fluid external to the chamber;

transmitting the fluid contained within the internal chamber to the fluid operated device;

operating the fluid operated device using the fluid transmitted from the milling apparatus to the device, to perform a downhole operation; and employing the mill guiding device to deflect the milling apparatus out through a wall of the downhole tubing to mill a window.

32. A method as claimed in claim 31, comprising:

transmitting the fluid in the chamber to the device;

and then releasing the milling apparatus from the mill guiding device and using the milling apparatus to mill the window, guided by the mill guiding device.

* * * * *